US007114475B2

(12) United States Patent
Vanderveen et al.

(10) Patent No.: US 7,114,475 B2
(45) Date of Patent: Oct. 3, 2006

(54) AIR CLEANER, VALVE COVER AND INTAKE MANIFOLD ASSEMBLY

(75) Inventors: James K. Vanderveen, Blenheim (CA); Vlad Negrut, Windsor (CA)

(73) Assignee: Siemens VDO Automotive Inc., Chatham (CA)

( * ) Notice: Subject to any disclaimer, the term of this patent is extended or adjusted under 35 U.S.C. 154(b) by 0 days.

(21) Appl. No.: 10/638,219

(22) Filed: Aug. 8, 2003

(65) Prior Publication Data

US 2004/0031460 A1 Feb. 19, 2004

Related U.S. Application Data

(60) Provisional application No. 60/403,528, filed on Aug. 14, 2002.

(51) Int. Cl.
*F01M 9/10* (2006.01)

(52) U.S. Cl. ..... 123/90.38; 123/184.21; 123/198 E; 29/888.01

(58) Field of Classification Search ..... 123/184.21, 123/198 E, 90.38; 29/888.01
See application file for complete search history.

(56) References Cited

U.S. PATENT DOCUMENTS 6,098,586 A * 8/2000 Bloomer ..... 123/184.21
6,167,855 B1 * 1/2001 Mammarella et al. ... 123/90.38
6,464,761 B1 * 10/2002 Bugli ..... 96/135

* cited by examiner

*Primary Examiner*—Andrew M. Dolinar
*Assistant Examiner*—Katrina B. Harris

(57) ABSTRACT

An air cleaner, intake manifold, and valve cover are integrated together for attachment to a vehicle engine. The air cleaner is positioned directly between the intake manifold and valve cover to provide a compact induction module. The induction module is mounted to the engine as a single unit. A throttle body is also incorporated into the intake manifold. A tube interconnects the air cleaner and the throttle body. An air filter is installed within the air cleaner to remove contaminants from air prior to entry into the tube.

24 Claims, 4 Drawing Sheets

AIR CLEANER, VALVE COVER AND INTAKE MANIFOLD ASSEMBLY

CROSS-REFERENCE TO RELATED APPLICATIONS

The application claims priority to U.S. Provisional Application No. 60/403,528, which was filed on Aug. 14, 2002.

BACKGROUND OF THE INVENTION

This invention is directed to an air cleaner, valve cover, and intake manifold assembly that can be attached to a vehicle engine as a single unit.

Many different types of components are attached to a vehicle engine to facilitate engine operation. Intake manifolds are mounted to an engine to conduct air into the engine cylinders. Air cleaners with filters are used to remove dust, dirt, and other particulate contaminants from the airflow prior to the air being drawn into the intake manifold. A throttle body is mounted to the engine and includes a valve that controls the amount of airflow into the engine valves. A valve cover is also mounted to the engine to enclose and protect the engine valves from environmental contaminants.

Traditionally, each of these components has been separately formed and mounted to the engine. This increases material and overall system costs. Further, the assembly of these components onto the engine is time consuming and labor intensive. One solution has been to try to incorporate the air cleaner into the intake manifold or into the valve cover, however, this configuration still requires multiple assembly steps and components.

Thus, it is the object of the present invention to provide a simplified air cleaner, intake manifold, and valve cover assembly that reduces the overall number of required components, and which can be easily assembled onto an engine as a single unit, as well as overcoming the other above-mentioned deficiencies with the prior art.

SUMMARY OF THE INVENTION

An air induction assembly integrates multiple components together to decrease material costs and to reduce assembly time of the components onto a vehicle engine. An intake manifold, air cleaner, and valve cover are assembled together to form an induction module. The induction module is mounted directly to the vehicle engine as a single unit.

In one disclosed embodiment the air induction assembly includes an air cleaner having an air cleaner inlet and an air cleaner outlet. The air cleaner inlet is in fluid communication with an air supply. An intake manifold is mounted to the air cleaner and has a manifold inlet in fluid communication with the air cleaner outlet. A valve cover is mounted to the air cleaner such that the valve cover, the intake manifold, and the air cleaner together form the induction module that is mounted to the vehicle engine. Preferably, the air cleaner is positioned directly between the valve cover and the intake manifold to provide a compact unit.

In one disclosed embodiment, a throttle body is also incorporated into the induction module. The throttle body is formed as part of the intake manifold and can provide an inlet positioned on a side or upper surface of the intake manifold. A tube interconnects the air cleaner outlet to the throttle body inlet. Sealed connections are formed at the tube-manifold interface and at the tube-air cleaner interface.

An air filter is installed within a cavity formed within the air cleaner. Any type of air filter can be used in the air cleaner. For example, a panel air filter or radial seal air filter could be used. Depending on the type of air filter and mounting configuration, an air cleaner lid can be mounted to the air cleaner. The lid is selectively moved between open and closed positions to allow access to the air filter for service or replacement operations.

The subject method and apparatus provides a compact and induction module that is easily mounted to a vehicle engine. These and other features of the present invention can be best understood from the following specifications and drawings, the following of which is a brief description.

DETAILED DESCRIPTION OF A PREFERRED EMBODIMENT

Figure 1:
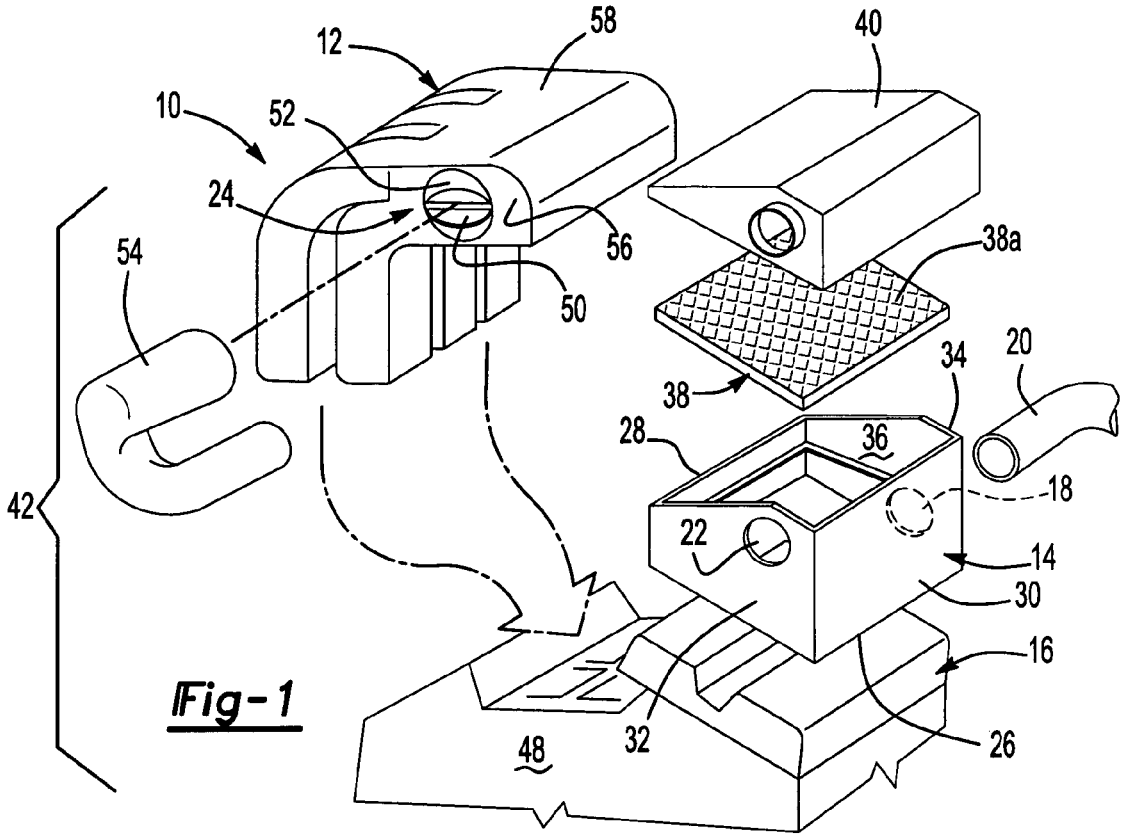
FIG. 1 is an exploded view of an air induction assembly incorporating the subject invention.

An air induction assembly, shown generally at 10 in FIG. 1, includes an intake manifold 12, an air cleaner 14, and a valve cover 16. The air cleaner 14 includes an air cleaner inlet 18 that is in fluid communication with an air supply 20. Typically, the air supply 20 comprises a tube or duct that conducts fresh air from the atmosphere into the air cleaner 14. The tube can be rigid or flexible and can be formed from any material known in the art. The air cleaner 14 also includes an air cleaner outlet 22 that is in fluid communication with the intake manifold 12, via a manifold inlet shown generally at 24.

The air cleaner 14 includes a bottom surface 26, a first longitudinal side wall 28, a second longitudinal side wall 30 that is parallel to and spaced apart from the first longitudinal side wall 28, a first lateral side wall 32 interconnecting the first 28 and second 30 longitudinal side walls, and a second lateral side wall 34 that is parallel to and spaced apart from the first lateral side wall 32. The side walls 28, 30, 32, 34 cooperate with the bottom surface 26 to form a rectangular shaped box or drawer having an inner cavity 36.

An air filter 38 is installed within the cavity 36 to filter out contaminants from the air. Air flows into the air cleaner inlet 18, through the air filter 38, and out the air cleaner outlet 22. An air cleaner lid or cover 40 is mounted to the air cleaner 14 to form the top surface. The air cleaner lid 40 encloses the air filter 38 within the cavity 36 and is selectively movable between open and closed positions to allow access to the air filter 38 for service or replacement operations. The lid 40 is preferably pivotally attached, however, other known attachment methods could also be used.

Figure 2:
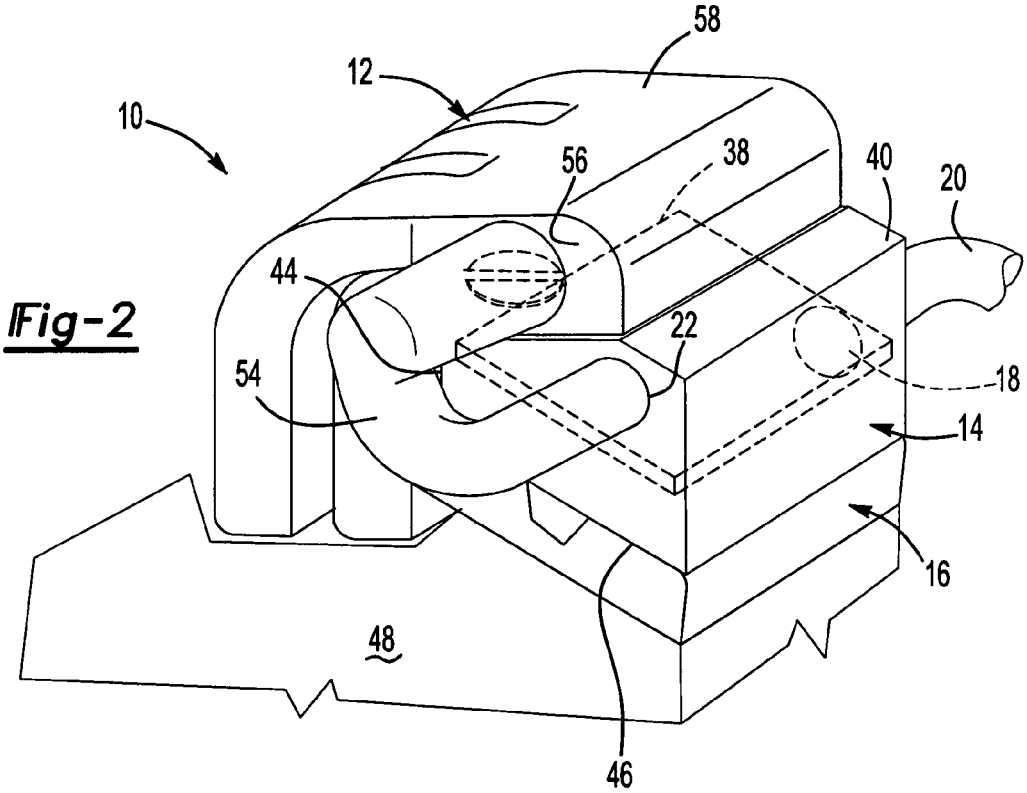
FIG. 2 is an assembled view of the air induction assembly of FIG. 1.

The air cleaner 14 is positioned directly between the valve cover 16 and the intake manifold 12 to form a compact induction module, shown generally at 42 in FIG. 2. The air cleaner 14 is preferably attached to the valve cover 16 along the bottom surface 26 of the air cleaner 14. The air cleaner 14 is preferably attached to the intake manifold 12 along one of the first or second longitudinal side walls 28, 30.

In one disclosed embodiment, the air cleaner 14, valve cover 16, and intake manifold 12 are formed from separate components that are welded or similarly attached together. At least one attachment interface 44 is formed between the intake manifold 12 and the air cleaner 14 and at least one attachment interface 46 is formed between the air cleaner 14 and the valve cover 16. Optionally, the air cleaner 14, valve cover 16, and/or intake manifold 12 could be integrally formed together as a single piece in a molding process.

Once the air cleaner 14, valve cover 16, and intake manifold 12 are assembled together to form the induction module 42, the induction module 42 is subsequently attached to a vehicle engine 48 as a single unit. Attaching the air cleaner 14, valve cover 16, and intake manifold 12 together to form the induction module 42 decreases material costs. Attaching the module 42 to the engine 48 as a single unit reduces assembly time and effort.

In one disclosed embodiment, a throttle body 50 is also optionally incorporated into the intake manifold 12. The throttle body 50 can be integrally formed with the manifold 12 or separately attached. The throttle body 50 includes an inlet 52 that is in fluid communication with the intake manifold 12. A tube 54 interconnects the air cleaner outlet 22 to the throttle body inlet 52. The tube 54 can be rigid or flexible and can be formed from any material known in the art. The tube 54 has sealed connections at each end to facilitate the transfer of clean air from the air cleaner 14 to the throttle body 50.

In the embodiments shown in FIGS. 1–4 and 7–8, the throttle body inlet 52 is formed on a side surface 56 of the intake manifold 12. In the embodiment shown in FIGS. 5–6, the throttle body inlet is formed on an upper surface 58 of the intake manifold 12, facing away from the engine 48.

In the embodiment shown in FIGS. 1–2, a panel air filter 38*a* is installed within the cavity 36. The panel air filter 38*a* is slidably received within the cavity 36 formed in the air cleaner 14 in a manner similar to that of a drawer sliding into a chest. The air cleaner inlet 18 is positioned on one side of the panel air filter 38*a* and the air cleaner outlet 22 is positioned on an opposite side of the panel air filter 38*a*. Air flows into the cavity 36 via the inlet 18, flows through the filter 38*a*, and flows out via the outlet 22. Once the panel air filter 38*a* is installed, the lid 40 is moved to the closed position.

In the embodiments shown in FIGS. 3–8, a radial seal air filter 38*b* is installed within the cavity 36 formed within the air cleaner 14. The radial seal air filter 38*b* includes a tube 60 that is surrounded by filtering material 62. The filtering material 62 circumferentially surrounds the tube 60 and extends along the length of the tube 60. One end 64 of the tube 60 is enclosed while the opposite end 66 of the tube 60 is in fluid communication with the air cleaner outlet 22.

Figure 4:
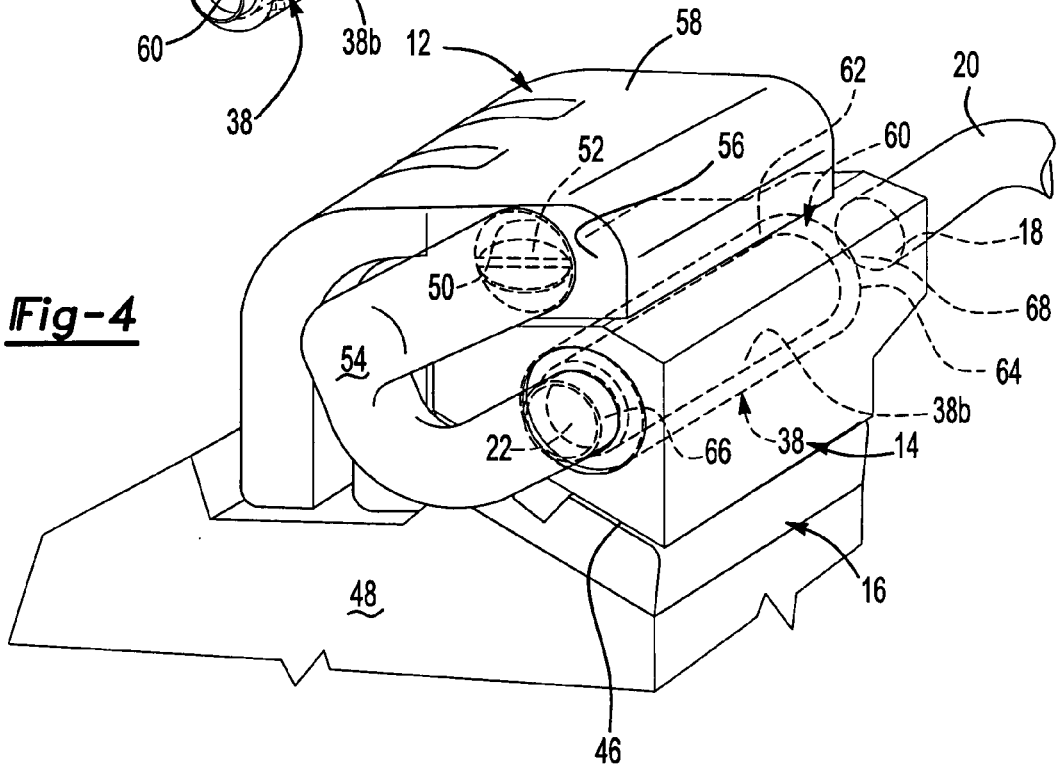
FIG. 4 is an assembled view of the air induction assembly of FIG. 3.

As shown in FIG. 4, the radial seal air filter 38*b* is shorter in length than the first and second longitudinal side walls 28, 30 of the air cleaner 14. Thus, a gap 68 is formed between the air cleaner inlet 18 and the enclosed end 64 of the tube 60. Air flows into the air cleaner inlet 18, flows around the radial seal air filter 38*b*, flows through the filtering material 62 and into the tube 60, and flows out the tube end 66 via the air cleaner outlet 22.

Figure 3:
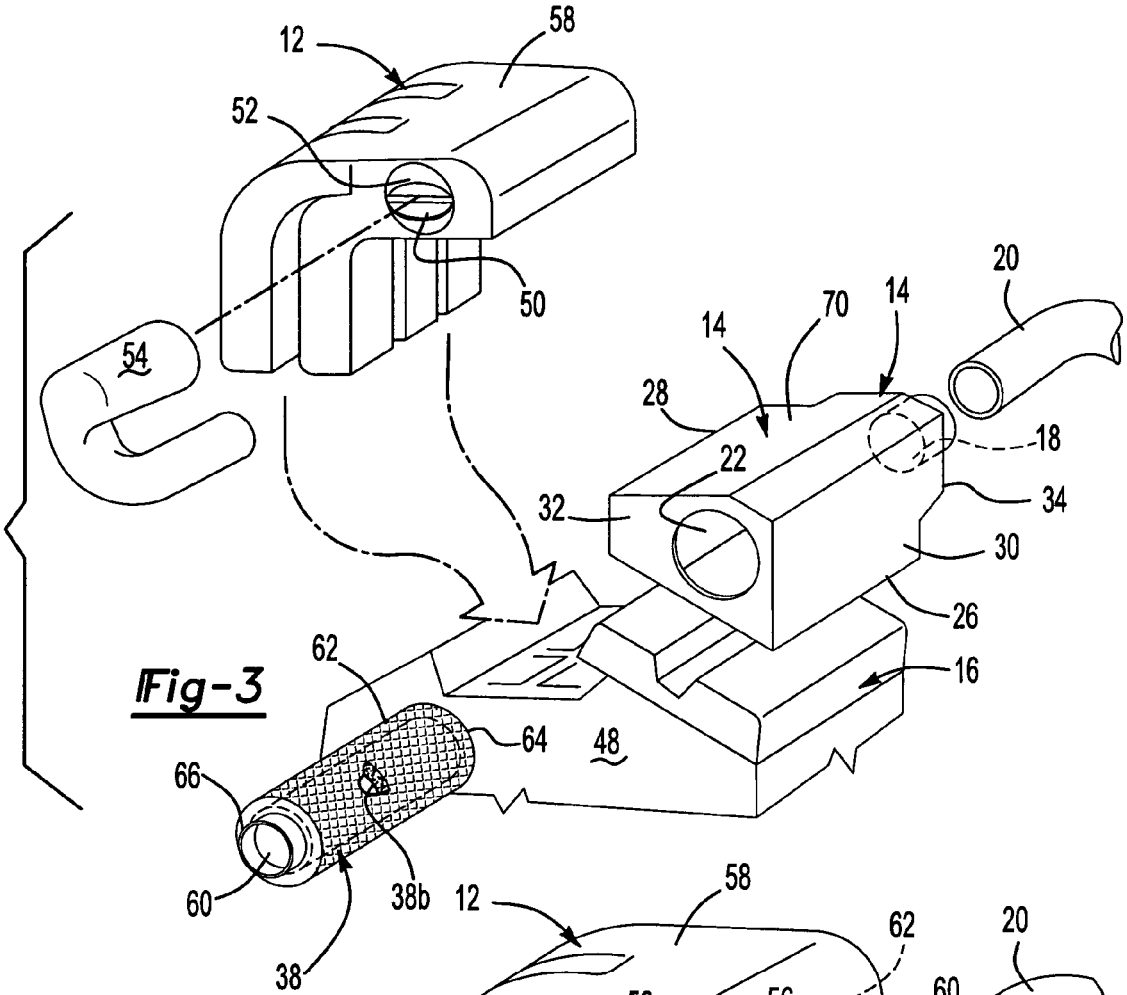
FIG. 3 is an exploded view of another example of an air induction assembly incorporating the subject invention.

In the embodiment of FIGS. 3–4, the air cleaner 14 includes a solid upper surface 70 that is attached to the side walls 28, 30, 32, 34. The radial seal air filter 38*b* is installed in the air cleaner 14 by being inserted through the inlet 18 or outlet 22. Thus, there is no need for an air cleaner lid 40.

Figure 5:
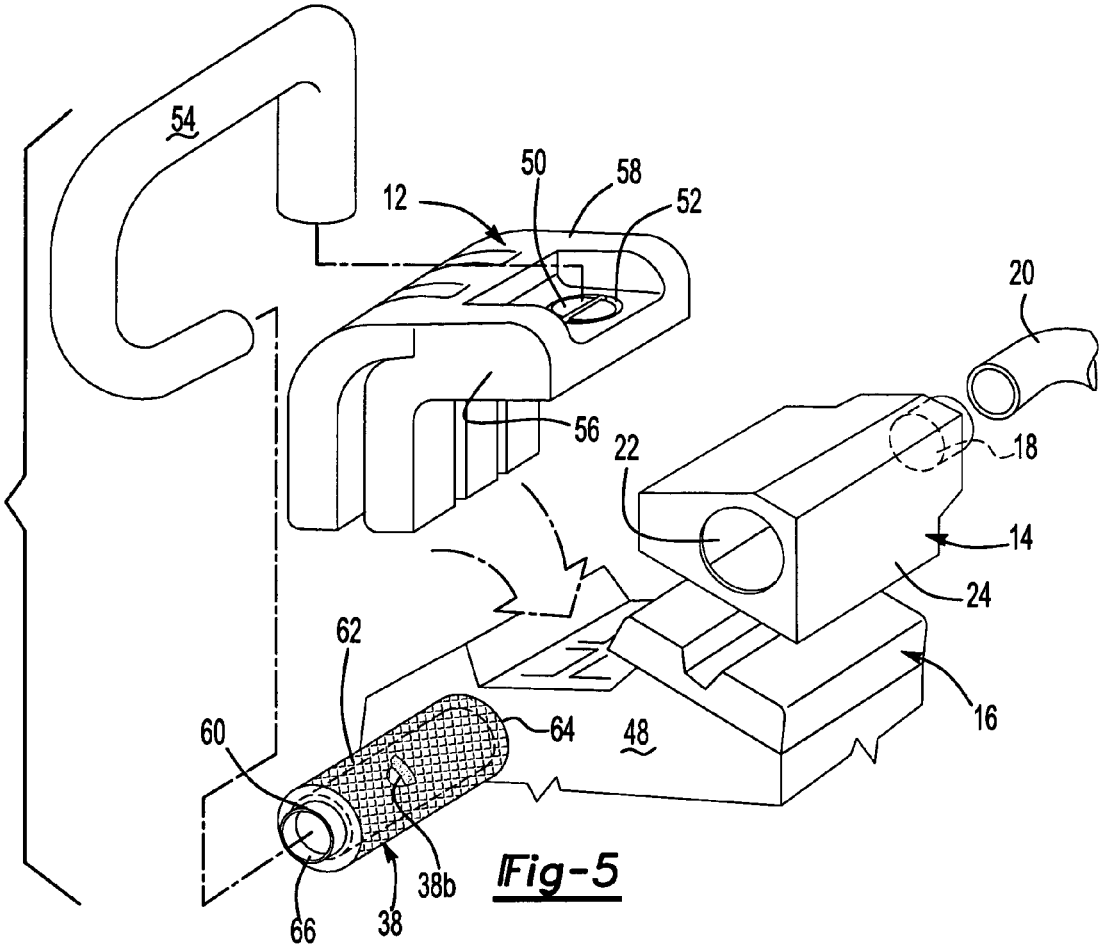
FIG. 5 is an exploded view of another example of an air induction assembly incorporating the subject invention.
Figure 6:
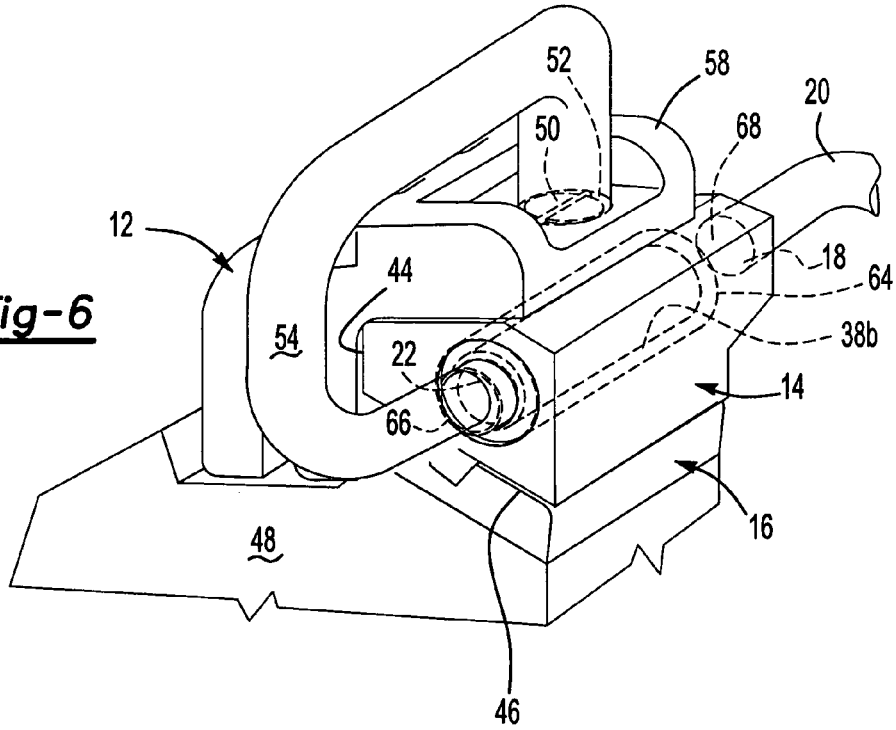
FIG. 6 is an assembled view of the air induction assembly of FIG. 5.

The embodiment of FIGS. 5–6 is similar to that of FIGS. 3–4 but shows the throttle body inlet 52 being positioned on the upper surface 58 of the intake manifold 12. It should be understood that while the throttle body inlet 52 is shown on the upper surface 58 of the intake manifold 12 in combination with a radial seal air filter 38*b*, the throttle body inlet 52 could also be positioned on the upper surface 58 in a panel air filter 38*a* configuration.

Figure 7:
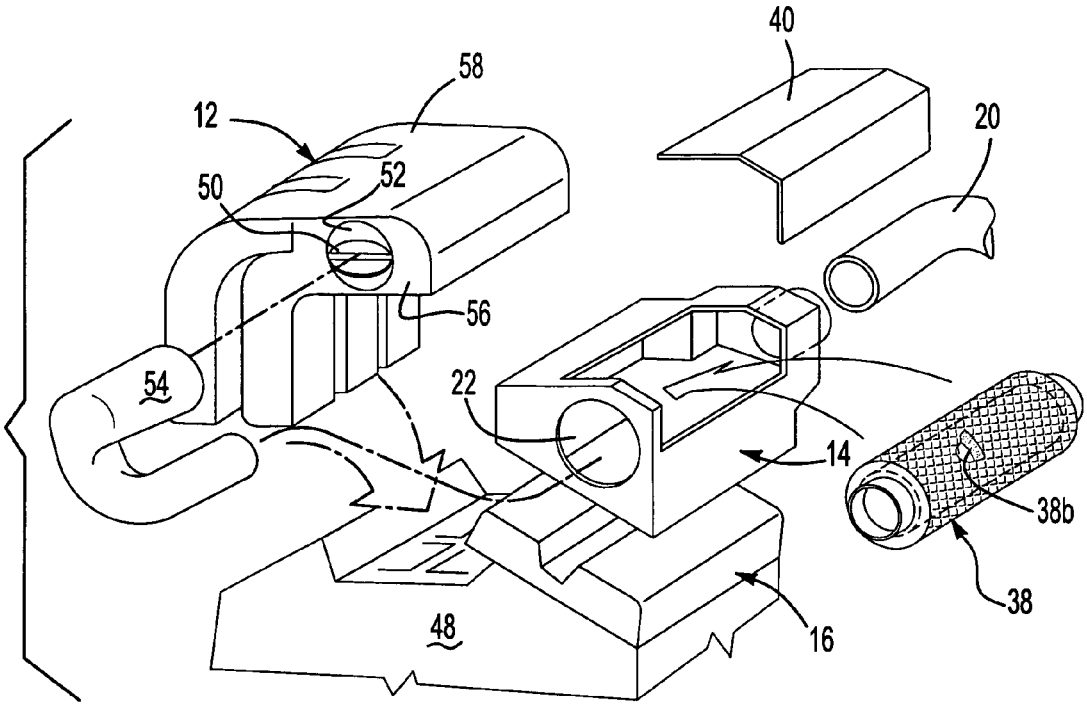
FIG. 7 is an exploded view of another example of an air induction assembly incorporating the subject invention.
Figure 8:
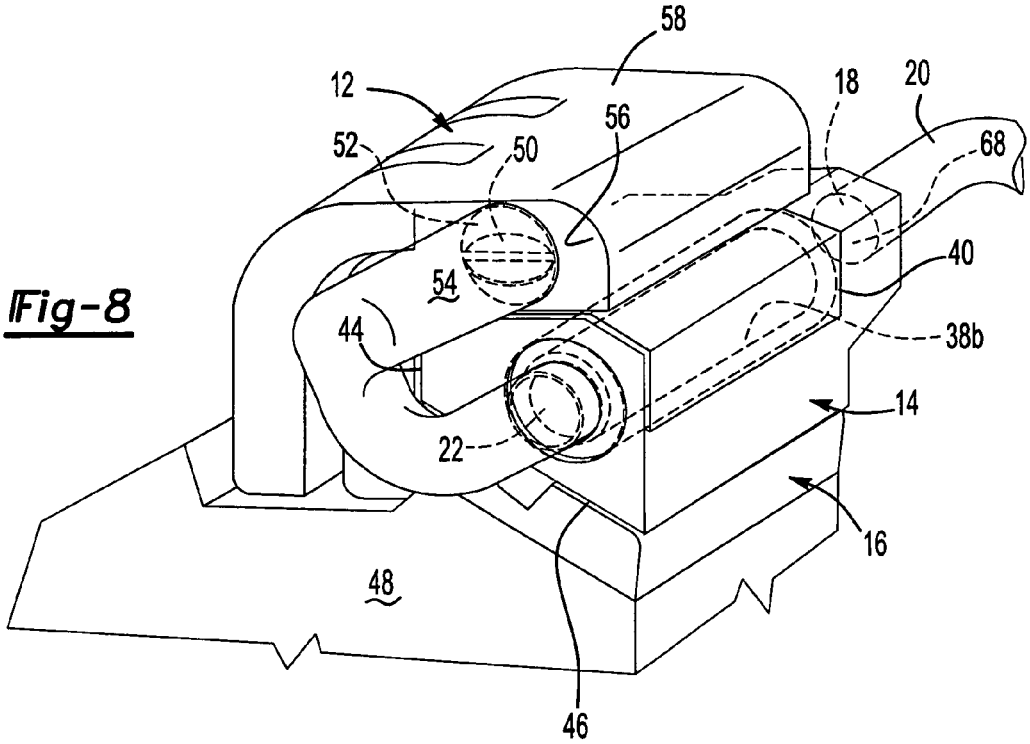
FIG. 8 is an assembled view of the air induction assembly of FIG. 7.

The embodiment of FIGS. 7–8 shows a radial seal air filter 38*b* with the air cleaner lid 40. As discussed above, the lid 40 is moved between open an closed positions to facilitate service of the air filter 38. The lid 40 is required in configurations where it is not easy to slide the radial seal air filter 38*b* into and out of the inlet 18 and/or outlet 22 openings in the air cleaner 14.

It should be understood that while panel 38*a* or radial seal 38*b* air filters are preferred, other similar air filters known in the art could also be installed within the cavity 36 to filter out air contaminants. Further, the position of the throttle body inlet 52 can be positioned at other locations on the intake manifold 12 and each of these throttle body positions could be used with either a panel 38*a* or radial seal 38*b* air filter.

The subject air induction assembly 10 can be used on any type of engine, such as 4 or 6 cylinder engines for example. Further the assembly 10 can be used on an in-line engine as well as on a V-shape or any other engine configuration.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. An air induction assembly for a vehicle engine comprising:

an air cleaner having an air cleaner inlet in fluid communication with an air supply and an air cleaner outlet;

an intake manifold mounted to said air cleaner and having a manifold inlet in fluid communication with said air cleaner outlet; and a valve cover mounted to said air cleaner such that said valve cover, said intake manifold, and said air cleaner together form an induction module wherein a portion of said air cleaner is positioned directly between said valve cover and said intake manifold and wherein said induction module is mounted to a vehicle engine as a single unit.

2. The assembly of claim 1 wherein said air cleaner, said intake manifold, and said valve cover are integrally molded together as a single piece.

3. The assembly of claim 1 including at least one attachment interface between said air cleaner and said intake manifold and including at least one attachment interface between said air cleaner and said valve cover.

4. The assembly of claim 1 including a throttle body mounted to said intake manifold and having a throttle body inlet in fluid communication with said air cleaner outlet.

5. The assembly of claim 4 including a tube sealed at one end to said air cleaner at said air cleaner outlet and at an opposite end to said throttle body inlet.

6. The assembly of claim 5 wherein said intake manifold has an upper surface facing away from said engine and wherein said throttle body inlet is incorporated into said upper surface.

7. The assembly of claim 5 wherein said throttle body inlet is incorporated into a side surface of said intake manifold.

8. An air induction assembly for a vehicle engine comprising:

an air cleaner having an air cleaner inlet in fluid communication with an air supply and an air cleaner outlet;

a panel air filter slidably received within a cavity formed within said air cleaner;

an intake manifold mounted to said air cleaner and having a manifold inlet in fluid communication with said air cleaner outlet; and a valve cover mounted to said air cleaner such that said valve cover, said intake manifold, and said air cleaner together form an induction module wherein said induction module is mounted to a vehicle engine as a single unit.

9. The assembly of claim 8 wherein said air cleaner inlet is positioned on one side of said panel air filter and said air cleaner outlet is positioned on an opposite side of said panel air filter.

10. The assembly of claim 9 including an air cleaner cover mounted to said air cleaner and selectively moveable between an open and closed position to provide access to said panel air filter.

11. The assembly of claim 1 including a radial seal air filter mounted within a cavity formed within said air cleaner, said radial seal air filter comprising a tube and filtering material circumferentially surrounding said tube and extending along the length of said tube wherein said tube includes an enclosed first end and an open second end in fluid communication with said air cleaner outlet.

12. The assembly of claim 11 including a gap formed between said enclosed first end and said air cleaner inlet such that air flows into said gap, flows around said radial seal air filter, flows through said filtering material into said tube, and flows out through said air cleaner outlet.

13. The assembly of claim 12 including an air cleaner cover mounted to said air cleaner and selectively moveable between an open and closed position to provide access to said radial seal air filter.

14. A method of mounting an air induction assembly to a vehicle engine comprising the steps of:

(a) assembling an intake manifold, air cleaner, and valve cover together to form an induction module including positioning the air cleaner directly between the valve cover and said intake manifold; and (b) mounting the induction module to a vehicle engine.

15. The method of claim 14 wherein step (a) further includes the step of attaching a throttle body to the intake manifold prior to step (b).

16. The method of claim 14 including the step of installing an air filter in a cavity formed within the air cleaner.

17. The method of claim 14 including the step of integrally forming the air cleaner, the intake manifold, and the valve cover as a single piece.

18. The method of claim 14 including forming a first attachment interface between the air cleaner and the intake manifold; forming a second attachment interface, separate from the first attachment interface, between the air cleaner and the valve cover; welding the air cleaner to the intake manifold at the first attachment interface; and welding the air cleaner to the valve cover at the second attachment interface.

19. The method of claim 14 wherein the air cleaner comprises a housing defining an air filter cavity and wherein step (a) includes attaching a lower surface of the housing to the valve cover, attaching an upper surface of the housing to the intake manifold such that the air cleaner is sandwiched between the intake manifold and the valve cover, forming an air cleaner inlet within one wall of the housing, forming an air cleaner outlet within another wall of the housing, installing a filter between the air cleaner inlet and the air cleaner outlet, forming an intake manifold inlet within a wall of the intake manifold, and connecting the air cleaner outlet to the intake manifold inlet with a tube.

20. The method of claim 14 including forming the air cleaner with a bottom surface, a first longitudinal side wall, a second longitudinal side wall that is parallel to and spaced apart from the first longitudinal side wall, a first lateral side wall interconnecting the first and the second longitudinal side walls, and a second lateral side wall that is parallel to and spaced apart from the first lateral side wall such that the first and second longitudinal side walls and the first and second lateral side walls cooperate with the bottom surface to form a box for substantially enclosing a filter; mounting the valve cover directly to the bottom surface of the air cleaner; and mounting the intake manifold directly along one of the first and second longitudinal side walls.

21. The assembly of claim 1 wherein said air cleaner comprises a housing defining an inner cavity for receiving a filter, and wherein said housing includes a lower portion directly attached to said valve cover and an upper portion directly attached to said intake manifold such that said housing is sandwiched between said valve cover and said intake manifold.

22. The assembly of claim 1 wherein said air cleaner includes a bottom surface, a first longitudinal side wall, a second longitudinal side wall that is parallel to and spaced apart from said first longitudinal side wall, a first lateral side wall interconnecting said first and said second longitudinal side walls, and a second lateral side wall that is parallel to and spaced apart from said first lateral side wall and wherein said first and second longitudinal side walls and said first and second lateral side walls cooperate with said bottom surface to form a box that substantially encloses a filter and wherein said valve cover is directly attached to said bottom surface of said air cleaner and said intake manifold is directly attached along one of said first and second longitudinal side walls.

23. An air induction assembly for a vehicle engine comprising:

an air cleaner having an air cleaner inlet in fluid communication with an air supply and an air cleaner outlet wherein said air cleaner includes a bottom surface, a first longitudinal side wall, a second longitudinal side wall that is parallel to and spaced apart from said first longitudinal side wall, a first lateral side wall interconnecting said first and said second longitudinal side walls, and a second lateral side wall that is parallel to and spaced apart from said first lateral side wall and wherein said first and second longitudinal side walls and said first and second lateral side walls cooperate with said bottom surface to form a box that substantially encloses a filter;

an air cleaner lid forming a top surface of said air cleaner to completely enclose the filter within said box wherein said air cleaner lid is pivotable between open and closed positions;

an intake manifold mounted to said air cleaner and having a manifold inlet in fluid communication with said air cleaner outlet; and a valve cover mounted to said air cleaner such that said valve cover, said intake manifold, and said air cleaner together form an induction module, and wherein said valve cover is directly attached to said bottom surface of said air cleaner, and said intake manifold is directly attached along one of said first and second longitudinal side walls, and wherein said induction module is mounted to a vehicle engine as a single unit.

24. The assembly of claim 22 wherein said air cleaner inlet is formed at a first opening within one of said first and second lateral side walls and wherein said air cleaner outlet is formed at a second opening within the other of said first and second lateral side walls with the filter extending between the first and second openings and wherein said manifold inlet is formed at a third opening within a side wall of the intake manifold and including a tube that extends outwardly from the second opening toward the third opening to fluidly connect said air cleaner outlet to said manifold inlet.

* * * * *